US005959653A

United States Patent [19]

Sekiya

[11] Patent Number: 5,959,653

[45] Date of Patent: Sep. 28, 1999

[54] PRINTER HAVING STRUCTURE FOR ATTACHING PRINT HEAD TO A FRAME

[75] Inventor: Hiroaki Sekiya, Chiba, Japan

[73] Assignee: Seiko Instruments Inc., Japan

[21] Appl. No.: 08/948,486

[22] Filed: Oct. 10, 1997

[30] Foreign Application Priority Data

Oct. 16, 1996 [JP] Japan ..... 8-273785

[51] Int. Cl.[6] ..... B41J 2/325

[52] U.S. Cl. ..... 347/222; 347/197

[58] Field of Search ..... 347/197, 215, 347/218, 222

[56] References Cited

U.S. PATENT DOCUMENTS 5,142,302 8/1992 Kano ..... 347/172

5,198,836 3/1993 Saito et al. ..... 347/222

*Primary Examiner*—N. Le

*Assistant Examiner*—Anh T. N. Vo

*Attorney, Agent, or Firm*—Adams & Wilks

[57] ABSTRACT

A printer comprises a frame having top, bottom, left and right surfaces, a base disposed along the bottom surface, and a pair of bearings each connected to the base and having a recessed portion. A platen is supported between the left and right surfaces of the frame to undergo rotation. A print head is supported between the left and right surfaces of the frame to undergo pivotal movement about a rotational axis into and out of contact with the platen and for printing on a recording paper fed between the platen and the print head. The print head has a pair of support shafts disposed along the rotational axis each for engagement with one of the recessed portions of the bearings. When the support shafts of the print head detachably engage with the recessed portions of the bearings and the print head is pivoted about the support shafts, the print head undergoes pivotal movement into and out of contact with the platen without being detached from the bearings.

27 Claims, 4 Drawing Sheets

PRINTER HAVING STRUCTURE FOR ATTACHING PRINT HEAD TO A FRAME

BACKGROUND OF THE INVENTION

The present invention relates to a printer for printing on recording paper, which comprises a platen and a printer head incorporated in a frame. More particularly, the present invention relates to a structure for incorporating a print head in a frame.

A general structure of a conventional printer is now described briefly in the following with reference to FIG. 2. As shown in FIG. 2A, a printer includes a platen 101 and a thermal head 102. The platen 101 is rotatably supported about an axis 101*a* along the width direction of recording paper (not shown). More specifically, a stepping motor 104 is connected with the axis 101*a* via a train of gears 103. The rotational motion of the stepping motor 104 is decelerated by the train of gears 103, and is transmitted rearwardly to the axis 101*a,* and the platen 101 is appropriately intermittently rotated for feeding paper in the direction shown by an arrow in the figure. The thermal head 102 comprises a circuit substrate 111 attached to a support body 112. A heater and a semiconductor device 114 for driving the heater are formed on the circuit substrate 111. A sealing resin 115 is provided over the semiconductor device 114 for protection. The thermal head 102 is disposed so as to face the platen 101 via recording paper. The thermal head 102 is swingably supported about an axis 105. During a printing operation, a heater of the thermal head 102 is pressed against the recording paper. With this state maintained, the heater is electrically energized to print a line of letters on the recording paper. After the printing of the line, the platen 101 is rotated in the direction shown by the arrow to feed the recording paper.

FIG. 2B shows a schematic cross-sectional structure of the printer shown in FIG. 2A. The thermal head 102 is disposed so as to face the platen 101 via a recording paper 106. When the thermal head 102 is swung counterclockwise about the axis 105 that is in parallel with but different from the axis 101*a* of the platen 101, the heater above the axis 105 is pressed against the platen 101. In order to provide the pressing force, a spring member 107 intervenes between the thermal head 102 and a frame 108 of the printer. On the contrary, when the thermal head 102 is swung clockwise against the urging force by the spring member 107, the heater of the thermal head 102 is retracted from the platen 101.

FIG. 3 is a schematic side cross-section of a specific structural example of the printer shown in FIG. 2. A frame 108 is substantially in the shape of a rectangular parallelepiped having top, bottom, left, and right faces. In the figure, the top face, the bottom face and the right face are represented as U, D, and R, respectively. It should be noted that the left face L is on the side opposite to the right face R. The platen 101 is rotatably, axially supported between the left and right faces L and R of the frame 108. The thermal head 102 is also axially supported between the left and right faces L and R of the frame 108, and openably swings with respect to the platen 101. Printing is carried out between the platen 101 and the thermal head 102 on recording paper (not shown) fed from the side of the bottom face D of the frame 108 and then the recording paper is discharged to the side of the top face U of the frame 108.

In the conventional structure shown in FIG. 3, a support shaft 105 penetrating both of the left and right faces L and R of the frame 108 supports both end portions 102*a* (only one of them is shown in the figure) of the thermal head 102. Therefore, to incorporate the thermal head 102 into the frame 108, it is required that the support shaft 105 is first inserted from the right face R or the left face L of the frame 108, and a component for regulating the movement of the support shaft 105 in the thrust direction is then mounted. Subsequently, the thermal head 102 is incorporated from, for example, the top face U, and both of the end portions 102*a* of the thermal head 102 are engaged with the support shaft 105. In this way, in the conventional printer, assembly and disassembly of the thermal head 102 is bi-directional or tri-directional. More specifically, in order to mount the support shaft 105 and to engage the thermal head 102 with the support shaft 105, the operation has to be carried out from the right face R and/or the left face L and from the top face U of the frame 108. Further, when the thermal head 102 is removed in order to replace a component, for example, the support shaft 105 is required to be pulled out of the frame 108 in the thrust direction. Therefore, if a train of gears for deceleration and the like are disposed nearby, all of them must be removed.

FIG. 4 illustrates a conventional printer with its assembly improved, which is disclosed in Japanese Utility Model Application Laid-open No. Hei 7-5745. A frame 201 of a printer body rotatably, axially supports a platen 202. A heat sink 204 is provided for a thermal head 203. A pressing component 205 presses the thermal head 203 held by the frame 201 to the side of the platen 202. Protrusions 206 and 206 are formed on the lower side of both longitudinal ends of the heat sink 204 of the thermal head 203. Bushes 207 and 207 are fitted onto the protrusions 206 and 206, respectively. The bushes 207 are D-shaped in section with one side of their outer periphery cut off, and are press fitted into the protrusions 206. Engagement holes 208 and 208, into which the bushes 207 and 207 are fitted, are formed on the lower side of both ends of the frame 201. The engagement holes 208 have insert grooves 208*a* on the lower side and holes 208*b* having a diameter permitting rotation of the D-shaped bushes 207 in section on the upper side. It should be noted that the width of the insert grooves 208*a* is made smaller than the diameter of the D-shaped portions of the bushes 207 so that the bushes 207 may slide into the insert grooves 208*a* when the thermal head 203 is mounted to the frame 201 and the bushes 207 may be prevented from falling down when the mounted thermal head 203 is slanted to the side of the platen 202. In order to make a print face of the thermal head 203 closely contact the outer periphery of the platen 202, the holes 208*b* are made slightly larger than the bushes 207, thereby permitting the bushes 207 to rattle to some extent and preventing over-restriction. The pressing component 205 has in its front a spring member 209 for pressing the thermal head 203 mounted to the frame 201. Stopper portions 210 are formed at both ends of the pressing component 25. Holes 213, each of which is fitted onto protrusions 212 for positioning the frame 201 in a holder 211 at its back, are formed. In this case, it is constructed that a head-up lever 214 releases the pressure of the thermal head 203 on the printing side, and the stopper portions 210 of the pressing component 205 are adapted to slide into receiving windows 215.

When the printer shown in FIG. 4 is assembled, the heat sink 204 of the thermal head 203 is inserted from the side of the bottom face of the frame 201. Furthermore, the bushes 207 and 207 are inserted into the insert grooves 208*a* and 208*a* of the respective engagement holes 208 and 208, and are slid upwardly. Under the state that the entire bushes 207 and 207 enter into the holes 208*b* and 208*b,* the thermal head 203 is slanted to the side of the platen 202. With this structure, the thermal head 203 is held by the frame 201 with the bushes 207 being prevented from falling down from the engagement holes 208. However, in this conventional printer, the thermal head 203 is incorporated into the frame from the side of the bottom face. Generally, in such a case that an automatic assembly is performed, the less the directions of incorporation of components are, the better it is. In addition, incorporation from the side of the top face is more preferable than that from the side of the bottom face. However, in the conventional printer shown in FIG. 4, the thermal head 203 has to be incorporated from the side of the bottom face, and thus, a process of reversing the frame 201 and the like have to be added, leading to a problem that the handling is complicated.

SUMMARY OF THE INVENTION

It is therefore an object of the present invention to simplify a process for assemblying a printer. In order to attain the above and other objects, the following measures are taken. That is, a printer according to the present invention comprises a frame, a platen, and a print head as a basic structure. The frame has top, bottom, left, and right faces and is substantially in the shape of a rectangular parallelepiped. The platen is rotatably axially supported between the left and right faces of the frame. The print head is also axially supported between the left and right faces of the frame, and openably swings with respect to the platen. With such a structure, printing is carried out on recording paper fed between the platen and the print head and then the recording paper is discharged to the side of the top face of the frame. The printer is characterized in that the frame comprises a pair of side wall portions formed along the left and right faces and a base portion formed along the bottom face for connecting the side wall portions with each other. Bearings, each having a recessed portion or notch, are integrally formed inside the side wall portions facing each other. Deformed support shafts are formed at both ends of the print head. With such a structure, when the print head is dropped from an opening in the top face of the frame toward the bottom face, each of the support shafts detachably engages with the corresponding bearing via each of the notches. After the engagement, the print head swings undetachably from the bearings about both of the support shafts, and opens and closes with respect to the platen.

According to the present invention, bearings are formed integrally with the frame inside the side wall portions of the frame. The support shafts are formed at the both ends of the thermal head. The bearings have notches, and the support shafts are, for example, cut to be D-shaped in section. The thermal head is dropped from the top face of the frame, and can be detached from the frame only at a predetermined angle. With this structure, incorporation of the thermal head can be carried out from the side of the top face, and the assembly process can be more simplified compared with that of a conventional printer.

DETAILED DESCRIPTION OF THE PREFERRED EMBODIMENTS

Figure 1A:
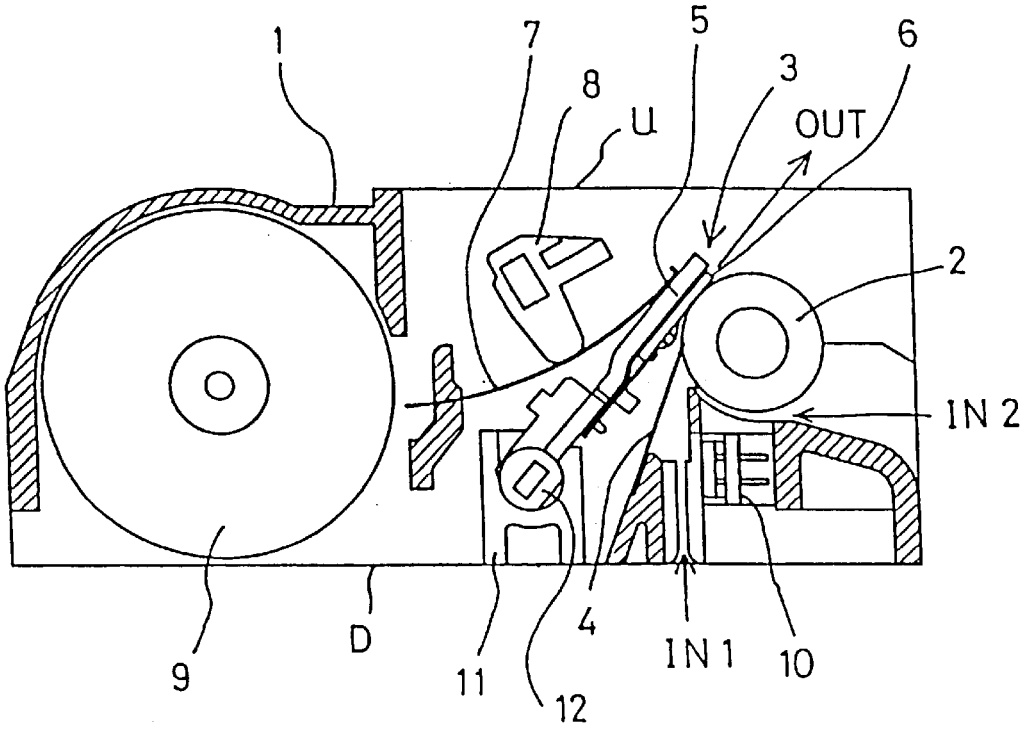
FIG. 1A is a sectional view of a printer as a finished product according to the present invention.
Figure 1B:
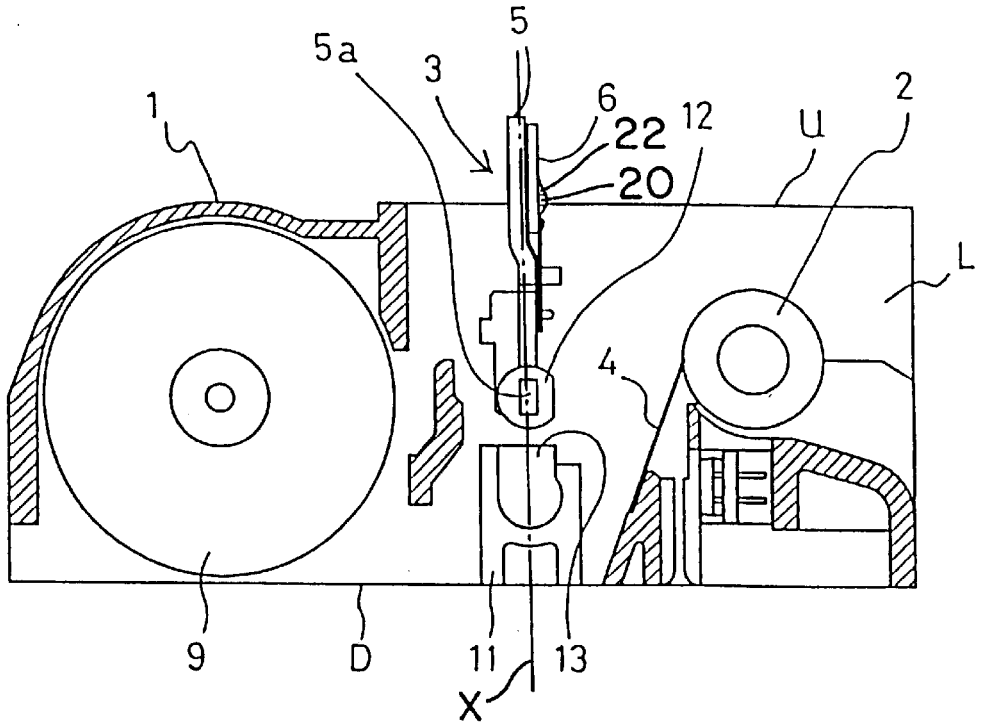
FIG. 1B is a sectional view of the printer when being assembled according to the present invention.
Figures 2A, 2B:
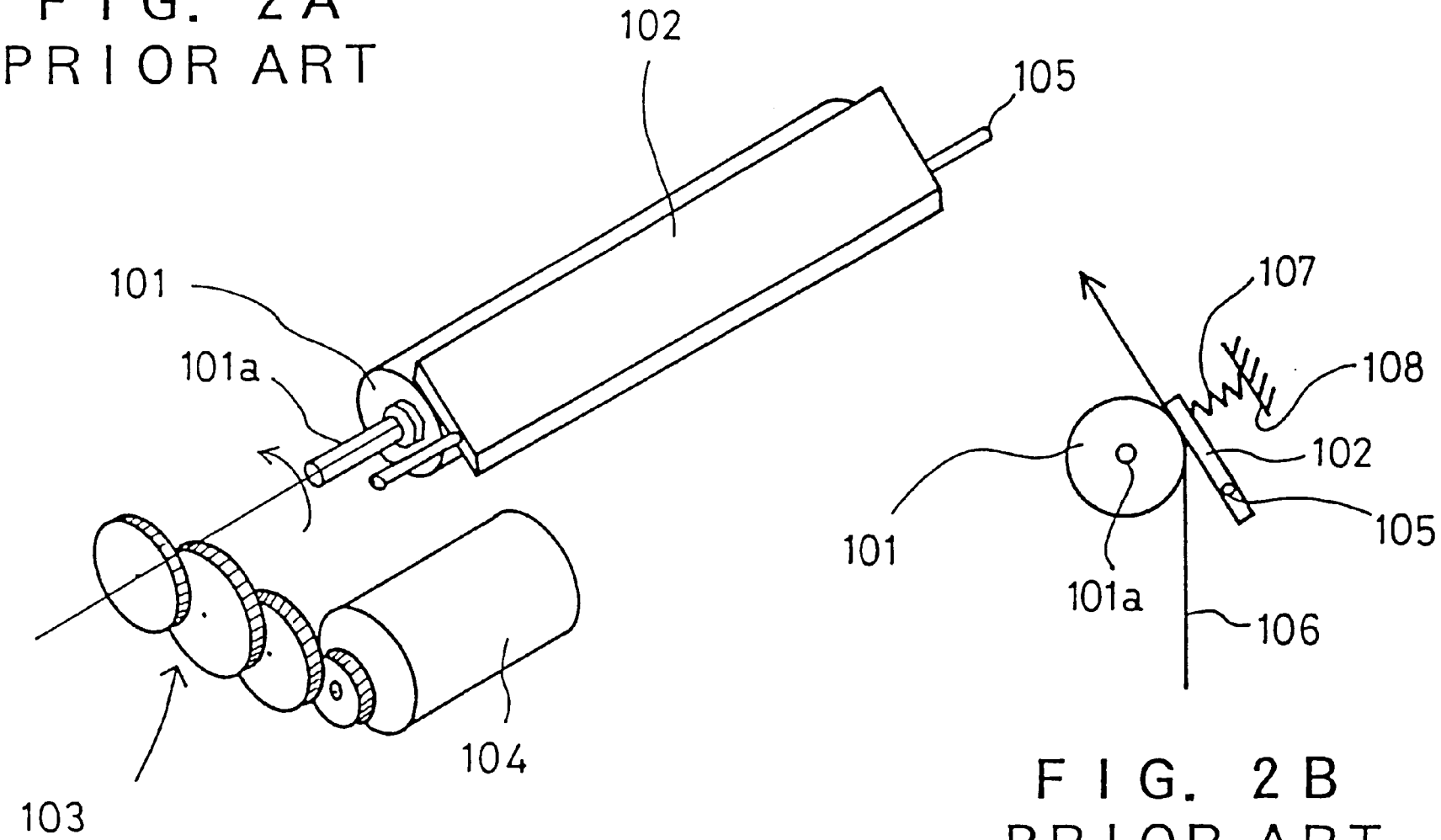
FIG. 2A PRIOR ART
FIG. 2B PRIOR ART
FIG. 2A is a schematic view illustrating a general structure of a conventional printer.
FIG. 2B is a schematic sectional view illustrating the general structure of the conventional printer in FIG. 2A.

The best mode of the present invention is now described in detail in the following with reference to the drawings. FIG. 1 is a schematic sectional view of the best mode of a printer according to the present invention. FIG. 1A shows the printer as a finished product while FIG. 1B shows the printer when being assembled/disassembled. As shown in FIG. 1A, the printer basically comprises a frame 1, a platen 2, and a thermal head 3. It is to be noted that other types of print heads may be used instead of the thermal head 3. The frame 1 is in the shape of a box having a top surface or face U, a bottom face D, a left face L, and a right face R (not shown). The platen 2 is rotatably, axially supported between the left and right faces L and R of the frame 1. Similarly, the thermal head 3 is also axially supported between the left and right faces L and R of the frame 1 to undergo pivotal movement into and out of contact with the platen 2. More specifically, the thermal head 3 is mounted on the frame 1 to undergo angular displacement within a preselected angular range relative to a reference axis X extending generally perpendicular to the bottom face D of the frame. With such a structure, as shown in FIG. 1B, printing is carried out on a recording paper (not shown) fed between the platen 2 and the thermal head 3 from the side of the bottom face D of the frame 1 and then the recording paper is discharged to the side of the top face U of the frame 1. In the figure, a supply port for recording paper formed in the bottom face D of the frame 1 is represented as IN1, and a discharge port positioned on the side of the top face U of the frame 1 is represented as OUT. A supply path from IN1 to OUT is referred to as a straight path. In this case, in order to prevent contact of the recording paper with a circuit element mounted on the thermal head 3, a protective sheet 4 intervenes between the platen 2 and the thermal head 3. It is to be noted that, depending on the situation, recording paper may be inserted from another supply port IN2 opening in the rear face of the frame 1 to be taken out from the discharge port OUT on the side of the top face U. A supply path from IN2 to OUT is referred to as a curled path. The thermal head 3 is formed by attaching a circuit substrate 6 made of ceramic or the like to a support body 5 formed of a metal plate or the like. A heater and a semiconductor device 20 for driving the heater are formed on the circuit substrate 6. A sealing resin 22 is provided over the semiconductor device 20 for protection. The thermal head 3 is pressed against the platen 2 by a pressing member or plate spring 7. The pressing force of the plate spring 7 is provided by a pressing member or pressure cam 8. Further, a stepping motor 9 for paper feed is incorporated in the frame 1. The stepping motor 9 is connected with the platen 2 via a decelerating train of gears (not shown) to drive the platen 2 to rotate. As the platen 2 rotates, the platen 2 feeds recording paper inserted from IN1 or IN2. It is to be noted that recording paper fed to the frame 1 is detected by a paper sensor 10. In the illustrated example, the paper sensor 10 monitors the straight path on the side of IN1.

The frame 1 comprises a pair of side wall portions formed along the left and right faces L and R and a base portion formed along the bottom face D for connecting the side wall portions with each other. Bearings 11 having notches 13, respectively, are integrally formed inside the side wall portions facing each other. In the figure, only a bearing 11 formed inside the side wall portion on the side of the left face L is shown. On the other hand, deformed support shafts 12 are formed at end portions of the support body 5 forming the thermal head 3. The support shafts 12 are connected to and disconnected from respective notches 13 at a preselected angle (e.g., approximately 0 degrees) relative to the reference axis X which is outside of the preselected angular range. By this construction, the print head 3 undergoes pivotal movement into and out of contact with the platen 2 without detachment of the support shafts 12 from the bearings 11.

Next, assembly/disassembly operation of the printer shown in FIG. 1A is described with reference to FIG. 1B. When the thermal head 3 is dropped vertically (e.g., approximately at 0 degree angle relative to the reference axis X from an opening in the top face U of the frame 1 toward the bottom face D, each of the support shafts 12 detachably engages with the corresponding bearing 11 via each of the notches 13. After the engagement, the thermal head 3 swings about both of the support shafts 12 without being detached from the bearings 11, and opens and closes so as to get away from and come in contact with the platen 2. More specifically, according to the present embodiment, the bearings 11 are formed integrally with the frame 1 inside the left and right side wall portions of the frame 1. For example, the frame 1 and the bearings 11 may be integrally formed by injection molding of a plastic material. On the other hand, the support shafts 12 are formed at the end portions of the support body 5 forming the thermal head 3. In the figure, the support shafts 12 are injection molded, D-shaped in section, and press fit into protruding end portions 5*a* of the support body 5. The support shafts 12 are, for example, formed by injection molding of polyacetal. However, the present invention is not limited to the specific example, and the support shafts 12 may be integrally formed with the support body 5 of the thermal head 3 by die casting or the like. The bearings 11 on the side of the frame 1 have the notches 13 opening upward, and the support shafts 12 on the side of the thermal head 3 are cut to be D-shaped in section. Accordingly, the thermal head 3 can be detached from the frame 1 only when held vertically as shown in the figure. Just by dropping the thermal head 3 vertically from the top face U of the frame 1 and then rotating the thermal head 3 over predetermined degrees, the thermal head 3 can be pivotally supported by the frame 1. Thus, assembly and disassembly of the thermal head 3 can be made to be unidirectional, i. e., only from the top face U.

Figure 3:
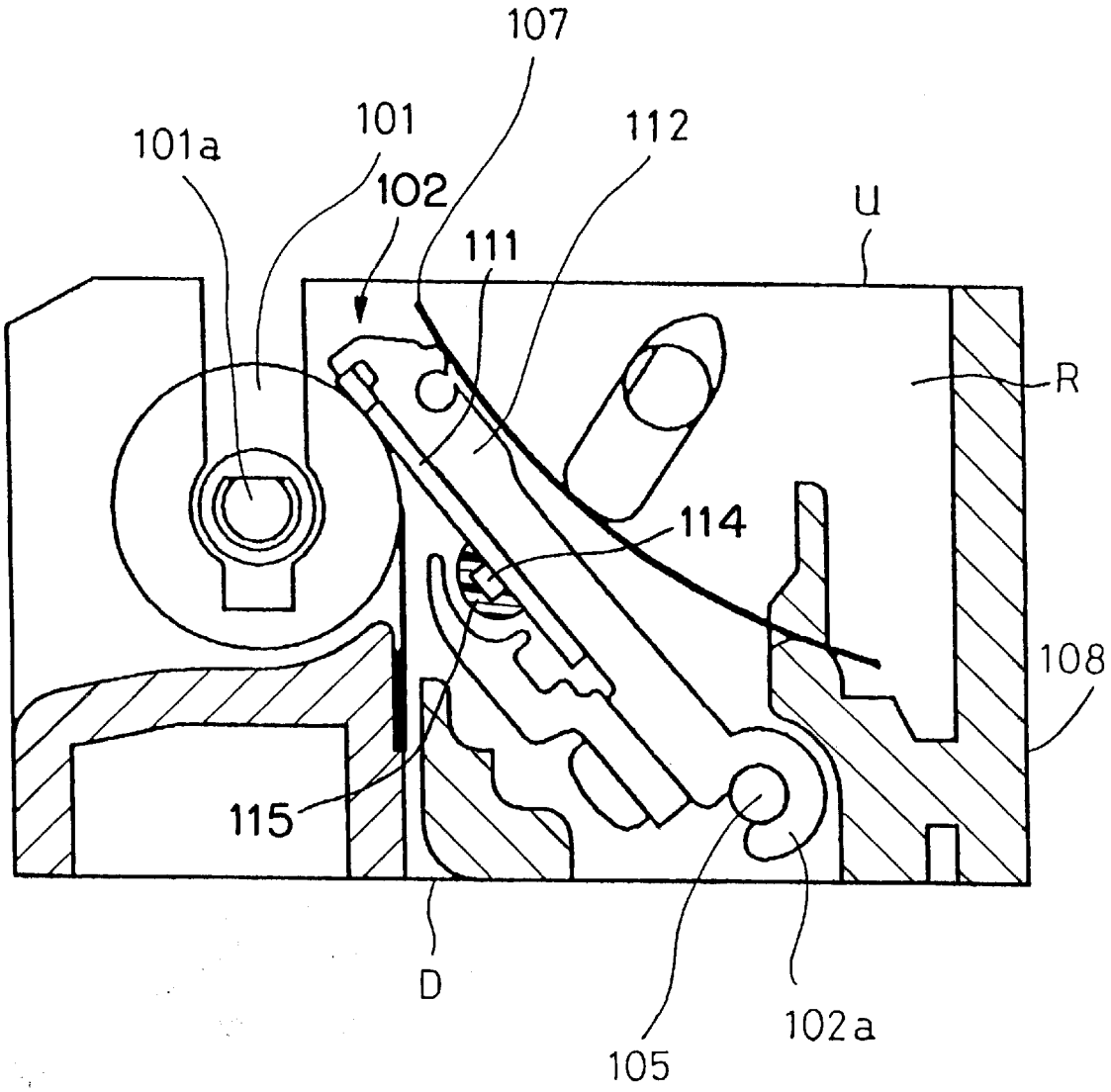
FIG. 3 PRIOR ART
FIG. 3 is a schematic sectional view of a specific structural example of the conventional printer.
Figure 4:
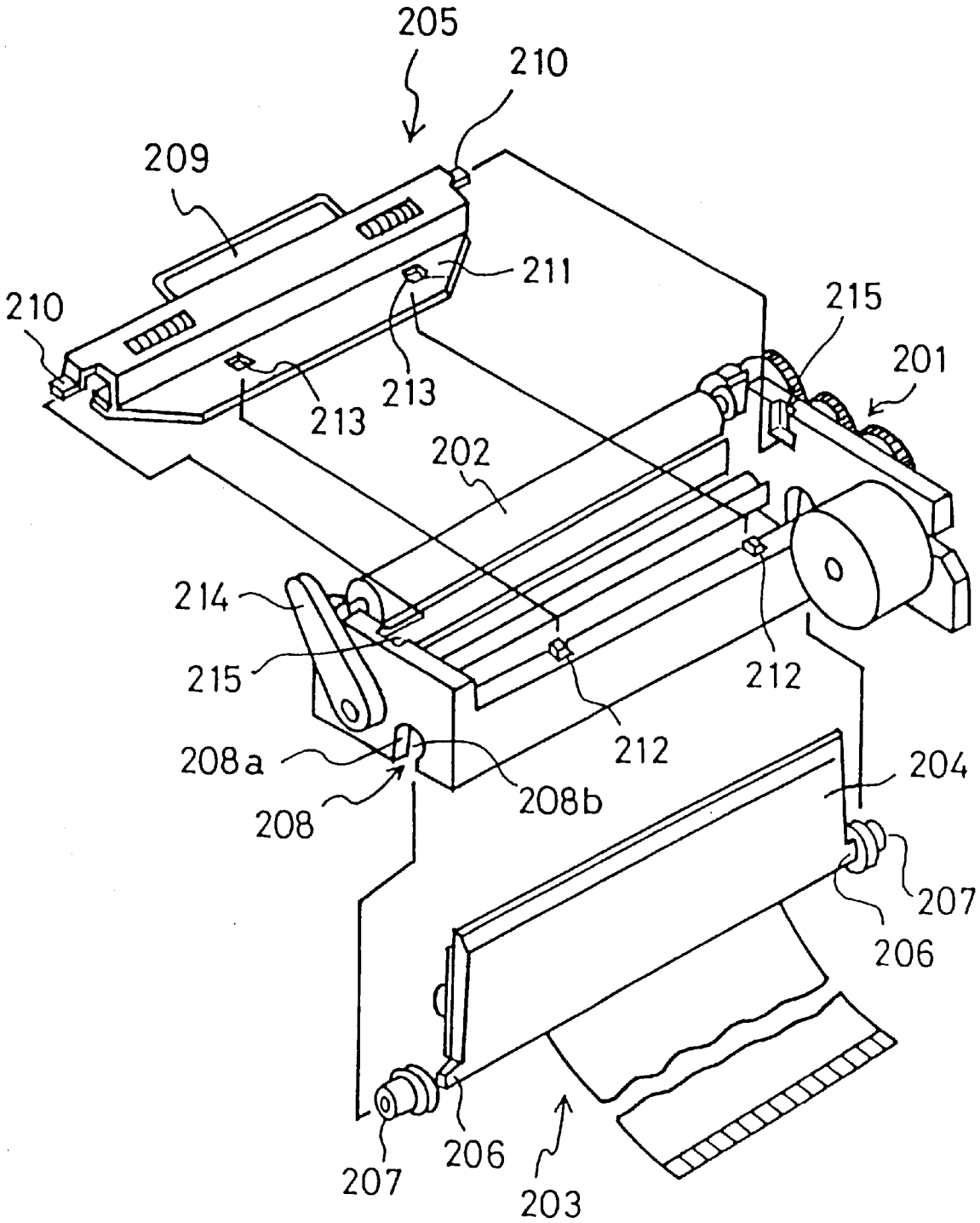
FIG. 4 PRIOR ART
FIG. 4 is an exploded perspective view of another example of the conventional printer.

As described above, according to the present invention, when the print head is dropped from the opening in the top face of the frame toward the bottom face, each of the support shafts detachably engages with the corresponding bearing via each of the notches. After the engagement, the print head swings or pivots undetachably from the bearings about both of the support shafts, and opens and closes with respect to the platen. With such a structure, assembly and disassembly of the print head can be made to be unidirectional, i. e., only from the top face of the frame, thereby simplifying the assembly process of the printer. Further, the number of components can be reduced as compared with that of the conventional printer shown in FIG. 3.

What is claimed is:

1. A printer comprising: a frame having top, bottom, left and right surfaces, a pair of side walls disposed along the left surface and the right surface, respectively, a base portion disposed along the bottom surface for connecting the side walls to one another, and a pair of bearings each disposed on one of the side walls and having a notch portion; a platen supported between the left and right surfaces of the frame to undergo rotation; and a print head having a pair of support shafts and supported between the left and right surfaces of the frame to undergo pivotal movement into and out of contact with the platen and for printing on a recording paper fed between the platen and the print head and discharged from the top surface of the frame, the top surface of the frame having an opening through which the print head is inserted for engagement with the bearings disposed on the side walls of the frame; wherein when the print head is inserted through the opening in the top surface of the frame and moved toward the bottom surface of the frame, each of the support shafts detachably engages the notch portion of one of the bearings, and after the engagement, the print head is supported between the left and right surfaces of the frame to undergo pivotal movement into and out of contact with the platen without being detached from the bearings.

2. A printer according to claim 1; wherein each of the bearings is injection molded with one of the side walls of the frame.

3. A printer according to claim 1; wherein the print head comprises a support body; and wherein the support shafts of the print head are injection molded with the support body.

4. A printer according to claim 3; wherein the support body and the support shafts of the print head comprise polyacetal.

5. A printer according to claim 1; further comprising a biasing member for resiliently pressing the print head into pressure contact with the platen; and a pressing member having a rotation shaft supported by the frame for pivotal movement for applying pressure to the biasing member to resiliently press the print head into pressure contact with the platen.

6. A printer comprising: a frame having top, bottom, left and right surfaces, a base disposed along the bottom surface, and a pair of bearings each connected to the base and having a recessed portion; a platen supported between the left and right surfaces of the frame to undergo rotation; and a print head supported between the left and right surfaces of the frame to undergo pivotal movement about a rotational axis into and out of contact with the platen and for printing on a recording paper fed between the platen and the print head, the print head having a pair of support shafts disposed along the rotational axis each for engagement with one of the recessed portions of the bearings; wherein when the support shafts of the print head detachably engage with the recessed portions of the bearings and the print head is pivoted about the support shafts, the print head undergoes pivotal movement into and out of contact with the platen without being detached from the bearings.

7. A printer according to claim 6; wherein the print head comprises a support body; and wherein the support shafts of the print head are injection molded with the support body.

8. A printer according to claim 7; wherein the support body and the support shafts of the print head comprise polyacetal.

9. A printer according to claim 6; further comprising a biasing member for resiliently pressing the print head into pressure contact with the platen; and a pressing member having a rotation shaft supported by the frame for pivotal movement for applying pressure to the biasing member to resiliently press the print head into pressure contact with the platen.

10. A printer comprising: a frame having a top wall, a bottom wall and a pair of side walls opposed to each other and connected to the top and bottom walls; a pair of bearings each having a recessed portion and being connected to a respective side wall of the frame; a platen supported between the pair of side walls of the frame to undergo rotation; a print head for printing on a recording medium fed between the print head and the platen, the print head being mounted between the pair of side walls of the frame to undergo angular displacement into and out of contact with the platen within a preselected angular range relative to a reference axis extending generally perpendicular to the bottom wall of the frame, the print head having a pair of support shafts for connection to and disconnection from respective recessed portions of the bearings at a preselected angle relative to the reference axis, the preselected angle being outside of the preselected angular range; and moving means for moving the print head to undergo angular displacement into and out of pressure contact with the platen within the preselected angular range without being disconnected from the bearings.

11. A printer according to claim 10; wherein the moving means comprises a biasing member for resiliently pressing the print head into pressure contact with the platen, and a pressing member having a shaft supported by the frame to undergo pivotal movement for applying pressure to the biasing member to resiliently press the print head into pressure contact with the platen.

12. A printer according to claim 10; wherein the print head comprises a support body; and wherein the support shafts of the print head are injection molded with the support body.

13. A printer according to claim 12; wherein the support body and the support shafts of the print head are formed of polyacetal.

14. A printer according to claim 10; wherein the print head comprises a support body having a pair of protruding end portions; and wherein each of the support shafts of the print head has a recess into which a respective protruding end portion of the support body is press fitted.

15. A printer according to claim 14; wherein the support body and the support shafts of the print head are formed of polyacetal by injection molding.

16. A printer according to claim 10; wherein the top wall of the frame has an opening; wherein during connection of the print head to the bearings of the frame, the print head is inserted through the opening of the top wall of the frame and the support shafts of the print head are connected to respective recessed portions of the bearings while maintaining the print head at the preselected angle; and wherein during disconnection of the print head from the bearings of the frame, the support shafts of the print head are disconnected from respective recessed portions of the bearings and the print head is removed through the opening of the top wall of the frame while maintaining the print head at the preselected angle.

17. A printer according to claim 16; wherein each of the recessed portions of the bearings has an open end through which the support shafts of the print head are respectively inserted and removed during respective connection and disconnection of the print head to and from the bearings, the open end of each of the recessed portions opening towards the top wall of the frame in the direction of the reference axis.

18. A printer according to claim 17; wherein the support shafts of the print head are generally D-shaped in cross-section.

19. A printer according to claim 10; wherein the recessed portions of the bearings comprise means defining notches.

20. A printer comprising: a frame having a top wall, a bottom wall and a pair of side walls opposed to each other and connected to the top and bottom walls, the top wall having an opening; a pair of bearings each having a recessed portion and being connected to a respective side wall of the frame; a platen supported between the pair of side walls of the frame to undergo rotation; and a print head for printing on a recording medium fed between the print head and the platen, the print head being mounted between the pair of side walls of the frame to undergo angular displacement into and out of contact with the platen within a preselected angular range relative to a reference axis extending generally perpendicular to the bottom wall of the frame, the print head having a pair of support shafts for connection to and disconnection from respective recessed portions of the bearings at a preselected angle relative to the reference axis, the preselected angle being outside of the preselected angular range; wherein during connection of the print head to the bearings of the frame, the print head is inserted through the opening of the top wall of the frame and the support shafts of the print head are connected to respective recessed portions of the bearings while maintaining the print head at the preselected angle; and wherein during disconnection of the print head from the bearings of the frame, the support shafts of the print head are disconnected from respective recessed portions of the bearings and the print head is removed through the opening of the top wall of the frame while maintaining the print head at the preselected angle.

21. A printer according to claim 20; wherein the print head comprises a support body; and wherein the support shafts of the print head are injection molded with the support body.

22. A printer according to claim 21; wherein the support body and the support shafts of the print head are formed of polyacetal.

23. A printer according to claim 20; wherein the print head comprises a support body having a pair of protruding end portions; and wherein each of the support shafts of the print head has a recess into which a respective protruding end portion of the support body is press fitted.

24. A printer according to claim 23; wherein the support body and the support shafts of the print head are formed of polyacetal by injection molding.

25. A printer according to claim 20; wherein each of the recessed portions of the bearings has an open end through which the support shafts of the print head are respectively inserted and removed during respective connection and disconnection of the print head to and from the bearings, the open end of each of the recessed portions opening towards the top wall of the frame in the direction of the reference axis.

26. A printer according to claim 20; wherein the recessed portions of the bearings comprise means defining notches.

27. A printer according to claim 26; wherein the support shafts of the print head are generally D-shaped in cross-section.

* * * * *